US006860365B2

(12) United States Patent
Stones

(10) Patent No.: US 6,860,365 B2
(45) Date of Patent: Mar. 1, 2005

(54) LUBRICATION SYSTEM FOR ROTATING MACHINES AND PUMPS

(75) Inventor: Ian David Stones, Burgess Hill (GB)

(73) Assignee: The BOC Group plc, Windlesham (GB)

( * ) Notice: Subject to any disclaimer, the term of this patent is extended or adjusted under 35 U.S.C. 154(b) by 103 days.

(21) Appl. No.: 10/164,804

(22) Filed: Jun. 7, 2002

(65) Prior Publication Data

US 2003/0015373 A1 Jan. 23, 2003

(30) Foreign Application Priority Data

Jun. 13, 2001 (GB) ..... 0114420

(51) Int. Cl.[7] ..... F01M 1/00
(52) U.S. Cl. ..... 184/6.16; 184/6.23; 184/6.26
(58) Field of Search ..... 184/6.16, 6.21, 184/6.23, 6.24, 6.26

(56) References Cited

U.S. PATENT DOCUMENTS

| | | | | |
|---|---|---|---|---|
| 3,659,674 A | * | 5/1972 | Ferrario | 184/6.16 |
| 3,877,546 A | | 4/1975 | Shrader | |
| 5,536,148 A | | 7/1996 | Nishiuchi et al. | |
| 6,578,670 B1 | * | 6/2003 | Klintenstedt et al. | 184/6.16 |
| 6,585,496 B1 | * | 7/2003 | Sun | 417/410.5 |

FOREIGN PATENT DOCUMENTS

| | | |
|---|---|---|
| DE | 10 09 865 B | 6/1957 |
| JP | 58 134299 A | 8/1983 |

OTHER PUBLICATIONS

European Search report completed Aug. 22, 2003 of Application No. EP 02 25 3962.

* cited by examiner

*Primary Examiner*—David Fenstermacher
(74) *Attorney, Agent, or Firm*—Ira Lee Zebrak

(57) ABSTRACT

A system for lubricating the upper bearing supporting a rotatable vertical shaft in a machine or pump comprising an axial bore extending along substantially the length of the shaft and communicating at its lower open end with a reservoir containing lubricating fluid, at least one radial oil hole extending between the axial bore and the upper bearing for the delivery of lubricating fluid thereto, the arrangement being such that centrifugal force generated during rotation of the shaft will draw lubricating fluid from the reservoir upwardly along the axial bore in the form of a thin film and towards the radial oil hole for delivery to the upper bearing, and an air delivery and demisting circuit including an air/lubricating fluid mist chamber communicating with the axial bore via at least one radial port located between the lower open end and the upper bearing, the port having a distal end extending in to the axial bore, at least one air hole extending between the axial bore and the outer cylindrical surface of the vertical shaft at a location above the upper bearing, and an impeller for pumping the air/lubricating fluid mist through the radial port and along the axial bore where the lubricating fluid is separated out by centrifugal force during rotation of the shaft to join the lubricating fluid film extending along the surface of the axial bore, clean air exiting the axial bore via the air hole above the upper bearing.

29 Claims, 3 Drawing Sheets

LUBRICATION SYSTEM FOR ROTATING MACHINES AND PUMPS

FIELD OF THE INVENTION

This invention relates to machines and pumps which incorporate a high speed rotatable vertical shaft supported by bearings at or adjacent each end of the shaft and in particular to lubricating systems for lubricating the upper bearing.

BACKGROUND OF THE INVENTION

In vacuum pumps of the regenerative type a rotor is mounted on a vertical shaft for rotation within a surrounding stator. The shaft is supported by upper and lower bearings which require lubrication. To facilitate lubrication of the upper bearing the shaft has a central axial bore and communicating radial holes in alignment with the upper bearing for delivering a lubricating fluid to the bearing.

A problem associated with lubricating the upper bearing is that it is frequently necessary to prevent or inhibit lubricating fluid from the upper bearing migrating in to the vacuum mechanism and hence in to the chamber being evacuated. To meet this problem it is known to create a barrier in the form of "clean" air.

In known systems either air or lubricating fluid in the form of oil may be delivered up the axial bore but not both. This results in either the air or the oil being delivered to the upper bearing by means externally of the shaft. If oil is delivered to the upper bearing via the axial bore of the shaft then significantly less power is consumed than using means, for example a pump external to the shaft since the centrifugal force generated by the spinning (rotating) shaft is utilised to drive the oil up the axial bore.

The purpose of delivering air to the upper bearing is to mix with the oil to create an oil mist for efficient lubrication but also, as aforesaid, to create a clean barrier to prevent or inhibit the migration of any oil from the upper bearing in to the vacuum mechanism. Thus the air at the upper bearing must not be contaminated with oil and since it is recirculated it must be demisted prior to arrival at the bearing. It is an advantage if the centrifugal force generated by the rotating shaft is utilised to provide a demisting effect on the air.

It is an object of the present invention to provide a system for lubricating the upper bearing supporting a rotating shaft forming part of a machine or pump which system allows both air and lubricating fluid to utilise the centrifugal effect of the rotating shaft.

SUMMARY OF THE INVENTION

According to this invention, a system for lubricating the upper bearing supporting a rotatable vertical shaft in a machine or pump comprises an axial bore extending along substantially the length of the shaft and communicating at its lower open end with a reservoir containing lubricating fluid, at least one radial oil hole extending between the axial bore and the upper bearing for the delivery of lubricating fluid thereto the arrangement being such that when the shaft is rotating centrifugal force will cause the lubricating fluid in the sump to flow upwardly along the axial bore in the form of a thin film towards the oil hole for delivery to the upper bearing; and an air delivery and demisting circuit including an air/lubricating fluid mist chamber communicating with the axial bore via at least one radial port located between the lower open end and the upper bearing, the port having a distal end extending in to the axial bore, at least one air hole extending between the axial bore and the outer cylindrical surface of the vertical shaft at a location above the upper bearing, and an impeller for pumping the air/lubricating fluid mist through the radial port and along the axial bore where the lubricating fluid is separated out by centrifugal force during rotation of the shaft, to join the film of lubricating fluid extending along the surface of the axial bore, clean air exiting the axial bore via the air hole above the upper bearing.

In a preferred embodiment, a plurality of circumferentially equi-spaced radial ports are located adjacent the lower open end of the axial bore upstream of an oil filter located in the axial bore.

Preferably the transverse cross-section of the axial bore at the location where the ports enter the axial bore has a formation, which consists of at least two different radial dimensions, such as a square, triangle or cloverleaf formation. These can be considered to have 'Major' (maximum) and 'Minor' (minimum) diameters or radial distances relative to the centre of rotation.

The radial air circulation ports are preferably externally sealed to the shaft and have a diameter smaller than the lubricating fluid film in the axial bore.

Preferably the impeller is located immediately below the upper bearing and is formed as a thread on the outside cylindrical surface of the shaft and includes a counter-face extending from the upper bearing.

BRIEF DESCRIPTION OF THE DRAWINGS

Embodiments of the invention will now be described by way of example reference being made to the Figures of the accompanying diagrammatic drawings in which.

DETAILED DESCRIPTION OF THE INVENTION

Figure 1:
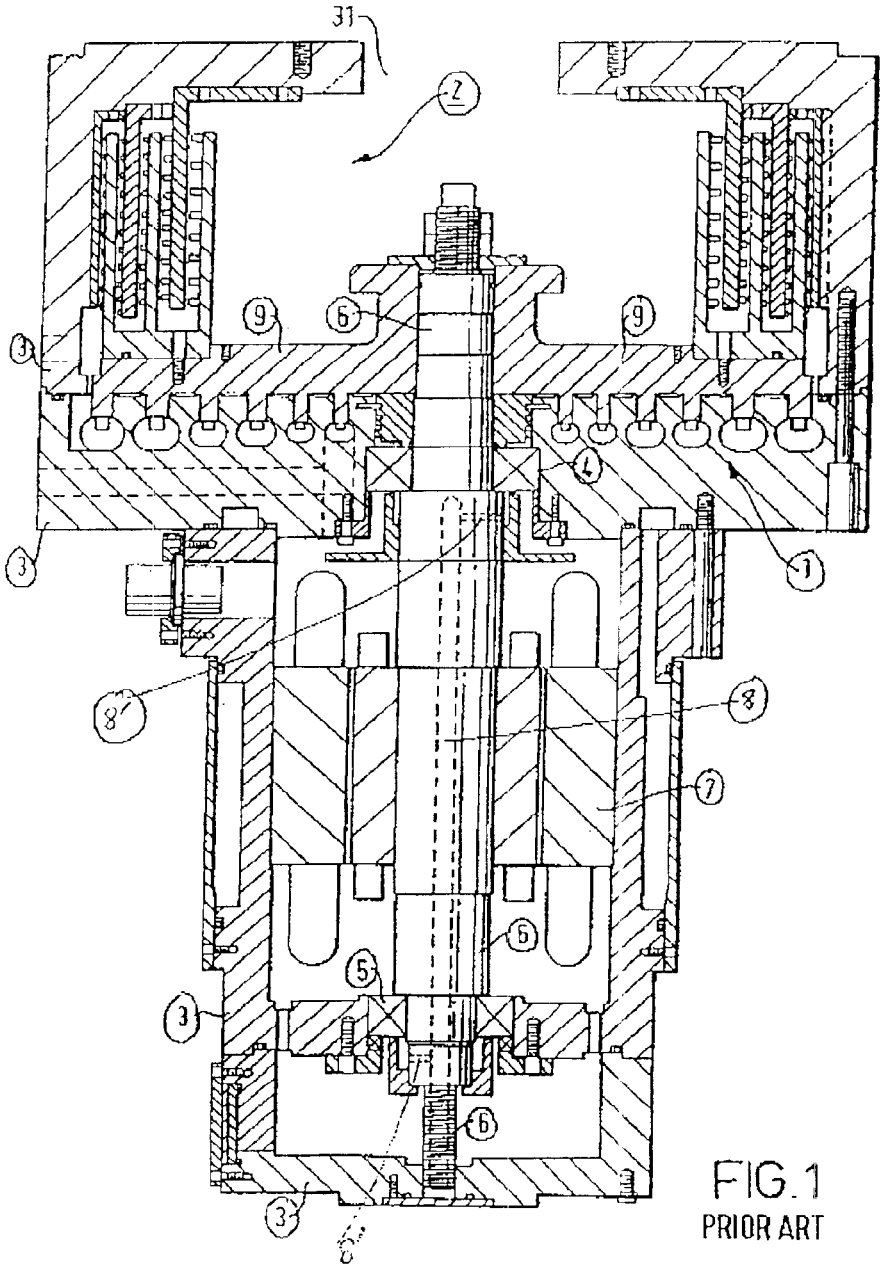
FIG. 1 PRIOR ART
FIG. 1 is a drawing of a known compound vacuum pump including a regenerative section.

Referring first to FIG. 1 which illustrates a known compound vacuum pump comprising a regenerative section 1 and a molecular drag (Holweck) section 2. The pump includes a casing 3 made from a number of different body parts bolted or otherwise fixed together and provided with relevant seals therebetween.

Mounted within the casing 3 is a vertical shaft 6 supported by an upper bearing 4 and a lower bearing 5. The shaft 6 is rotatable about its longitudinal axis and is driven by an electric motor 7 surrounding the shaft 6. Securely attached to the shaft for rotation therewith is a rotor 9. An axial bore 8 extends along a substantial length of the shaft and communicates with radial oil holes 8' for delivering lubricating fluid from a sump to the upper bearing 4.

Figures 2, 3:
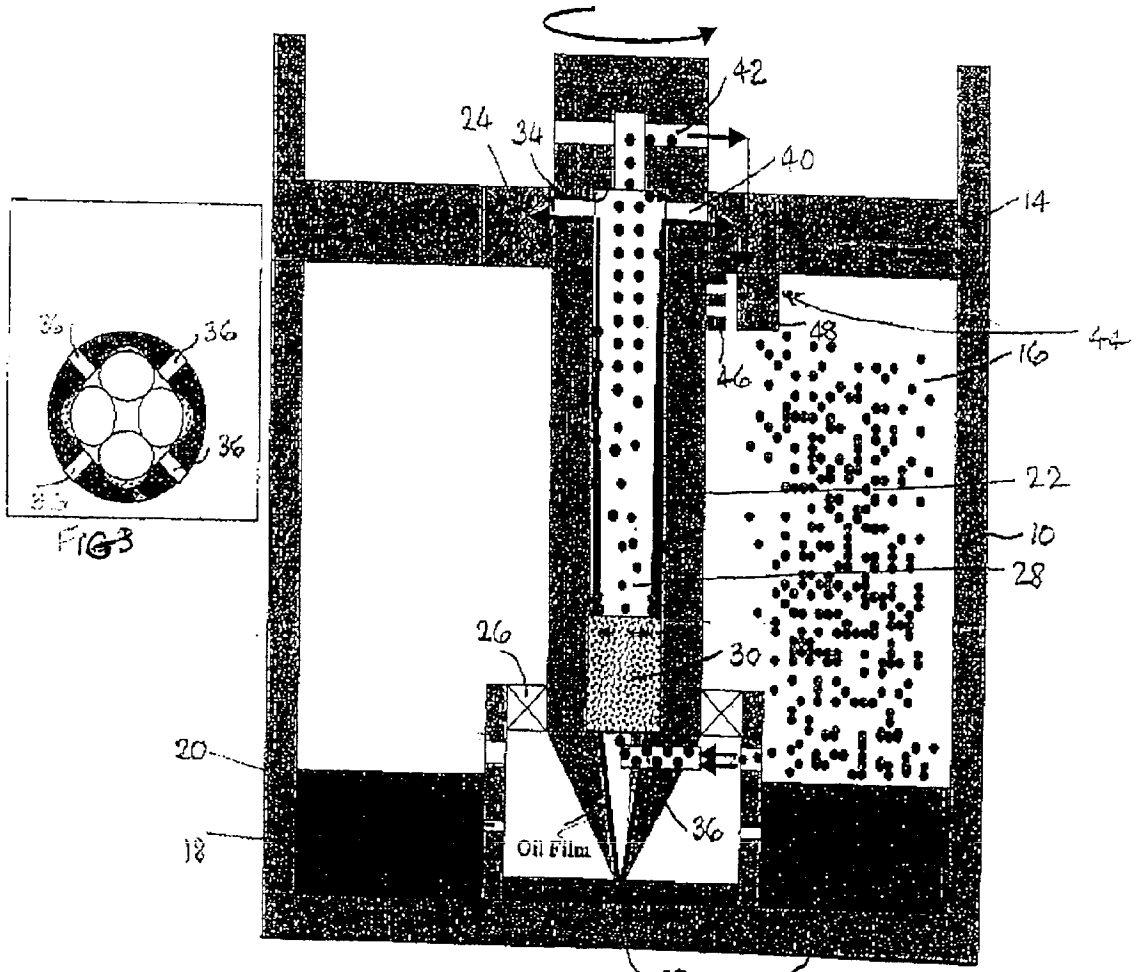
FIG. 2 is a cross-section through part of a vacuum pump illustrating a lubrication system for lubricating an upper bearing of a rotating shaft according to the present invention.
FIG. 3 is a transverse cross-section through the shaft of FIG. 2.

Referring now to FIGS. 2 and 3, a casing 10 fines with a base plate 12 and a cover plate 14, a chamber or sump 16 containing lubricating fluid in the form of oil. Within the sump 16 and supported by the base plate 12 is a shaft oil reservoir 18. Lubricating oil contained within the sump 16 enters the reservoir 18 in a controlled manner (known per se) via inlets 20 in the reservoir wall.

A vertical rotatable shaft 22 forming part of a vacuum pump is mounted in upper bearing 24 and lower bearing 26. The shaft 22 is generally cylindrical and has formed therein an axial bore 28 open at its lower end 29 in the reservoir 18. The transverse cross section of the axial bore 28 is generally cylindrical for most of its length having a large diameter section containing an oil filter 30, a main central section of slightly less diameter and an upper section of smaller diameter than the main central section which together with the main central section defines a downwardly facing shoulder 34. However, that section of the axial bore 28 between the open end 29 and the filter 30 has a cross section in the form of a "cloverleaf" (see FIG. 3).

Formed in the wall of the shaft 22 below or upstream of the filter 30 and communicating with the cloverleaf section of the axial bore 28 are a plurality (as shown) radial ports 36. As shown, the distal end of each port 36 extends in to the axial bore 28 and has a diameter smaller than the axial bore major diameter at the location where it enters the axial bore.

Also formed in the wall of the shaft 22 in alignment with the upper bearing 24 are a plurality of radial oil holes 40 in communication with the main central section of the axial bore 28.

Finally, at a location above the upper bearing 24 formed in the wall of the shaft 22 are a plurality of radial air holes 42 in communication with the upper section of the axial bore 28.

An axial impeller 44 is located in the casing 10 immediately below the upper bearing 24 which impeller consists of an impeller thread 46 formed on the outer surface of the shaft 22 and a static counter-face 48 depending from the outer race of the bearing 24.

The axial impeller 44, ports 36, axial bore 28 and air holes 42 together define an air delivery and demisting circuit as will be explained.

In use, when the shaft 22 is rotating oil will be drawn from the reservoir 18 through the open lower end 29 of the axial bore 28 by centrifugal force. The oil will travel axially up the axial bore 28 towards the oil holes 40 as a thin film.

The air/oil mist in the chamber 16 above the oil enters the axial bore 28 at its minor diameter via the ports 36 and in to the cloverleaf section of the axial bore 28. The first stage for separating the oil out from the oil mist occurs as the oil molecules collide with the walls of the radial ports 36 and are centrifuged outwardly. The centrifugal force on the oil from the reservoir 18 ensures that the oil passes around the ports 36 at the major diameter without escaping out from the ports.

A second stage for separating the oil out from the oil mist occurs at the filter 30 again to ensure that the oil is centrifuged out of the oil mist. The oil film travelling axially up the axial bore 28 towards the oil holes 40 is typically thin and hence there is a central core of "clean air". The filter 30 will centrifuge the oil content in the axial bore 28 towards the bore walls so that once it is entrained on the walls the centrifugal action will prevent/inhibit it from being re-entrained in the air at the core. As the substantially low content of oil remaining in the core leaves the filter 30 it will travel up the shaft due to the pressure drop created by the impeller 44. Further contact with the surfaces of the axial bore 28 will cause the oil to be centrifuged out of the oil mist and become part of the oil film already established on the walls. Cleanliness of the core air will improve in the direction of travel upwardly through the axial bore 28.

The air ports 42 are located axially above the oil ports 40 and as explained the axial bore diameter is substantially reduced between the oil ports and the air ports (either by tapering or as shown). In the unlikely event that traces of oil escape both the centrifugal filtration and collision with the walls past the oil holes 40 towards the air holes 42 centrifugal force from the reduced diameter section of the axial bore 28 will prevent the oil from reaching the air holes 42.

It will be evident that the centrifugal force created by the rotating shaft 22 is utilised both to draw the oil from the reservoir 18 towards the upper bearing 24 and to deliver clean air above the upper bearing to create a barrier against migration of oil from the upper bearing 24 in to the vacuum mechanism of the pump.

Figure 4:
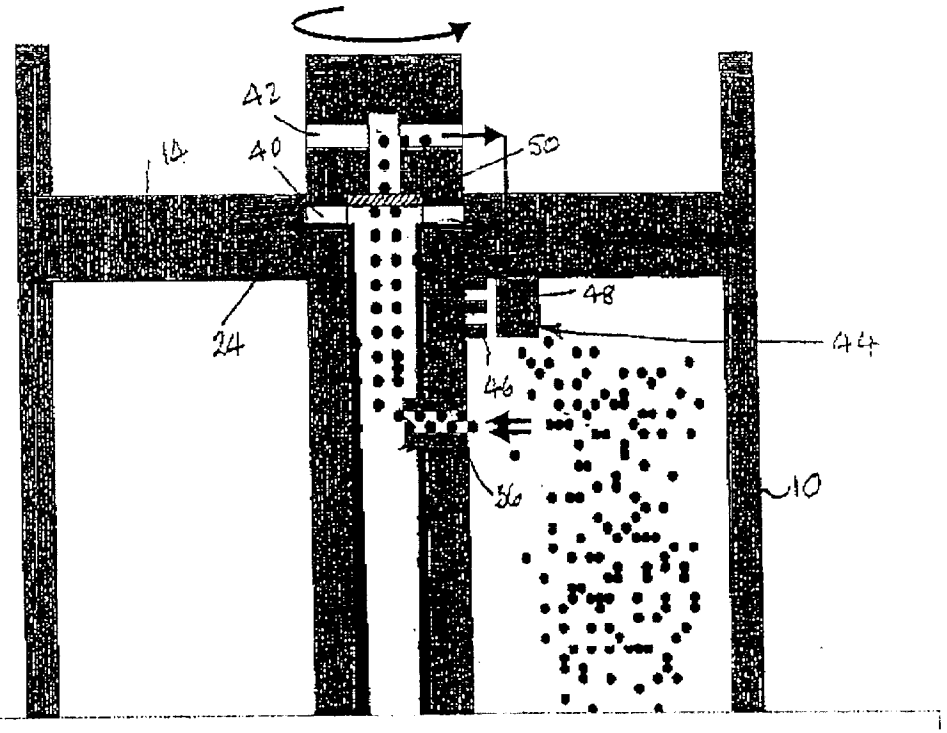
FIG. 4 is a cross-section similar to FIG. 2 but illustrating a modification to the lubricating system.

Turning now to FIG. 4, this illustrates substantially the same lubricating system as explained with reference to FIGS. 2 and 3 with the exception that the radial ports 36 are now located nearer the upper end of the axial bore 28, Furthermore, a filter 50 is located on the shoulder 34 to remove residual oil mist in the air core prior to exit of the air through the air holes 42. The final filter 50 can take the form of a sintered insert which creates an optically opaque barrier such that air travelling towards the air ports 42 impacts the filter 50 and any final traces of oil will be centrifuged out of the air flow before reaching the air ports 42.

What is claimed is:

1. A system for lubricating the upper bearing supporting a rotatable vertical shaft in a machine or pump comprising an axial bore extending along substantially the length of the shaft and communicating at its lower open end with a reservoir containing lubricating fluid, at least one radial oil hole extending between the axial bore and the upper bearing for the delivery of lubricating fluid thereto, the arrangement being such that centrifugal force generated during rotation of the shaft will draw lubricating fluid from the reservoir upwardly along the axial bore in the form of a thin film and towards the radial oil hole for delivery to the upper bearing, and an air delivery and demisting circuit including an air/lubricating fluid mist chamber communicating with the axial bore via at least one radial port located between the lower open end and the upper bearing, the port having a distal end extending in to the axial bore, at least one air hole extending between the axial bore and the outer cylindrical surface of the vertical shaft at a location above the upper bearing, and an impeller for pumping the air/lubricating fluid mist through the radial port and along the axial bore where the lubricating fluid is separated out by centrifugal force during rotation of the shaft to join the lubricating fluid film extending along the surface of the axial bore, clean air exiting the axial bore via the air hole above the upper bearing.

2. A lubricating system as claimed in claim 1, in which a plurality of circumferentially equi-spaced radial ports are located adjacent the lower open end of the axial bore upstream of an oil filter located in the axial bore.

3. A lubricating system as claimed in claim 2, in which the transverse cross section of the axial bore at the location where the ports enter the axial bore is defined by at least two different diameters.

4. A lubricating system as claimed in claim 2, in which the transverse cross section of the axial bore at the location where the ports enter the axial bore is cloverleaf.

5. A lubricating system as claimed in claim 1, in which the at least one radial port is externally sealed to the shaft and has a diameter smaller than the lubricating fluid film in the axial bore.

6. A lubricating system as claimed in claim 2, in which the at least one radial port is externally sealed to the shaft and has a diameter smaller than the lubricating fluid film in the axial bore.

7. A lubricating system as claimed in claim 3, in which the at least one radial port is externally sealed to the shaft and has a diameter smaller than the lubricating fluid film in the axial bore.

8. A lubricating system as claimed in claim 4, in which the at least one radial port is externally sealed to the shaft and has a diameter smaller than the lubricating fluid film in the axial bore.

9. A lubricating system as claimed in claim 1, in which the axial bore diameter is reduced at a location between the radial oil hole and the radial air hole.

10. A lubricating system as claimed in claim 2, in which the axial bore diameter is reduced at a location between the radial oil hole and the radial air hole.

11. A lubricating system as claimed in claim 3, in which the axial bore diameter is reduced at a location between the radial oil hole and the radial air hole.

12. A lubricating system as claimed in claim 4, in which the axial bore diameter is reduced at a location between the radial oil hole and the radial air hole.

13. A lubricating system as claimed in claim 5, in which the axial bore diameter is reduced at a location between the radial oil hole and the radial air hole.

14. A lubricating system as claimed in claim 9, in which an oil filter is located between the radial oil hole and the radial air hole.

15. A lubricating system as claimed in claim 1, in which the impeller is formed as a thread on the outside cylindrical surface of the vertical shaft and includes a counter-face extending from the upper bearing.

16. A lubricating system as claimed in claim 2, in which the impeller is formed as a thread on the outside cylindrical surface of the vertical shaft and includes a counter-face extending from the upper bearing.

17. A lubricating system as claimed in claim 3, in which the impeller is formed as a thread on the outside cylindrical surface of the vertical shaft and includes a counter-face extending from the upper bearing.

18. A lubricating system as claimed in claim 4, in which the impeller is formed as a thread on the outside cylindrical surface of the vertical shaft and includes a counter-face extending from the upper bearing.

19. A lubricating system as claimed in claim 5, in which the impeller is formed as a thread on the outside cylindrical surface of the vertical shaft and includes a counter-face extending from the upper bearing.

20. A lubricating system as claimed in claim 9, in which the impeller is formed as a thread on the outside cylindrical surface of the vertical shaft and includes a counter-face extending from the upper bearing.

21. A lubricating system as claimed in claim 14, in which the impeller is formed as a thread on the outside cylindrical surface of the vertical shaft and includes a counter-face extending from the upper bearing.

22. A vacuum pump including a system for lubricating the upper bearing supporting a rotatable vertical shaft as claimed in claim 1.

23. A vacuum pump including a system for lubricating the upper bearing supporting a rotatable vertical shaft as claimed in claim 2.

24. A vacuum pump including a system for lubricating the upper bearing supporting a rotatable vertical shaft as claimed in claim 3.

25. A vacuum pump including a system for lubricating the upper bearing supporting a rotatable vertical shaft as claimed in claim 4.

26. A vacuum pump including a system for lubricating the upper bearing supporting a rotatable vertical shaft as claimed in claim 5.

27. A vacuum pump including a system for lubricating the upper bearing supporting a rotatable vertical shaft as claimed in claim 9.

28. A vacuum pump including a system for lubricating the upper bearing supporting a rotatable vertical shaft as claimed in claim 14.

29. A vacuum pump including a system for lubricating the upper bearing supporting a rotatable vertical shaft as claimed in claim 15.

* * * * *